US005244415A

United States Patent [19]

Marsilio et al.

[11] Patent Number: 5,244,415

[45] Date of Patent: Sep. 14, 1993

[54] SHIELDED ELECTRICAL CONNECTOR AND CABLE

[75] Inventors: Ronald S. Marsilio, Westport; Curtis Hopkins, Sandy Hook, both of Conn.

[73] Assignee: Harbor Electronics, Inc., Ridgefield, Conn.

[21] Appl. No.: 832,740

[22] Filed: Feb. 7, 1992

[51] Int. Cl.[5] ..... H01R 13/648; H01R 13/58

[52] U.S. Cl. ..... 439/610; 439/456; 439/465

[58] Field of Search ..... 439/610, 456, 459, 465, 439/466, 467

[56] References Cited

U.S. PATENT DOCUMENTS

| | | | |
|---|---|---|---|
| 3,569,900 | 3/1972 | Uberbacker | 439/465 |
| 4,210,380 | 7/1980 | Brzostek | 439/456 |
| 4,272,148 | 6/1981 | Knack, Jr. | 439/610 |
| 4,408,823 | 10/1983 | Huber | 439/465 |
| 4,428,641 | 1/1984 | Flachbarth et al. | 439/572 |
| 4,514,029 | 4/1985 | Lax et al. | 439/610 |
| 4,761,145 | 8/1988 | Goto | 439/469 |
| 4,772,212 | 9/1988 | Sotolongo | 439/610 |
| 4,902,249 | 2/1990 | Morishita | 439/610 |
| 4,983,131 | 1/1991 | Esteban et al. | 439/456 |
| 5,145,404 | 9/1992 | Beattie et al. | 439/465 |
| 5,195,909 | 3/1993 | Huss, Jr. et al. | 439/465 |

FOREIGN PATENT DOCUMENTS

| | | | |
|---|---|---|---|
| 3346610 | 8/1984 | Fed. Rep. of Germany | 439/466 |
| 7409034 | 1/1976 | Netherlands | 439/465 |
| 2201306 | 8/1988 | United Kingdom | 439/465 |

*Primary Examiner*—Gary F. Paumen

*Attorney, Agent, or Firm*—St. Onge Steward Johnston & Reens

[57] ABSTRACT

A shielded electrical computer cable connector that has high strength and resistance to crushing forces includes a shield base and a shield cover formed from die cast zinc which together form a shielded chamber. A shielded cable is received in one end of the shielded chamber and a connector module having electrical terminals is secured to the other end of the shielded chamber. The shield base has several conductor alignment columns which retain cable wiring within the chamber in alignment with the terminals in the connector module, and which also support the shield cover.

10 Claims, 3 Drawing Sheets

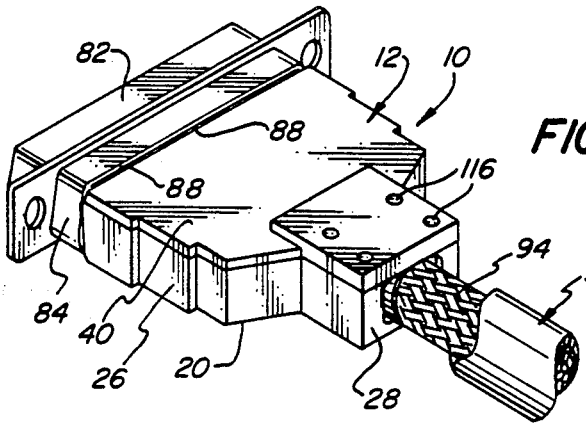
FIG. 1
FIG. 2
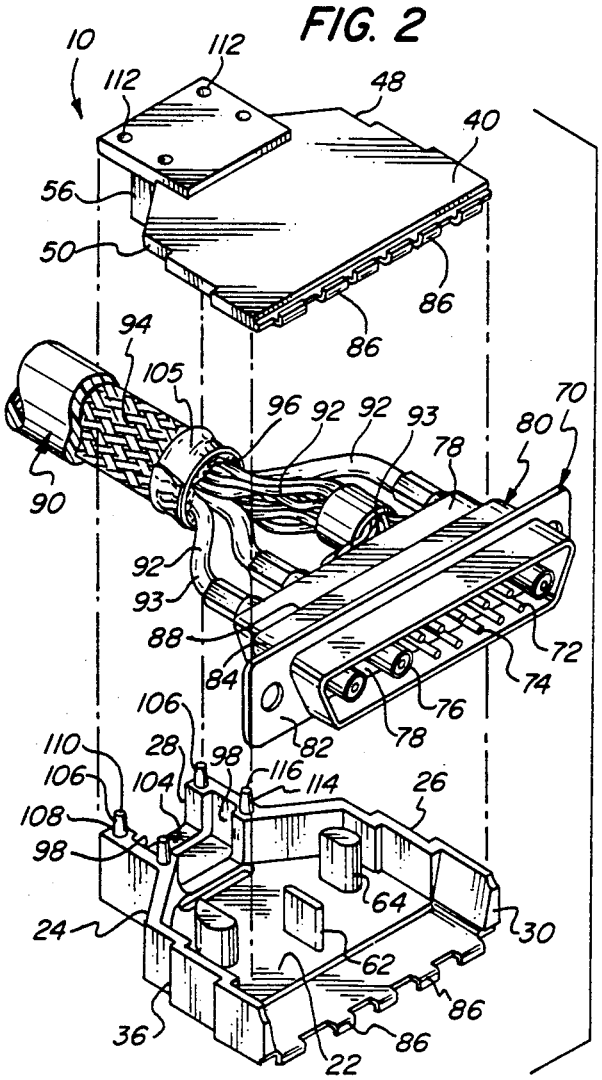
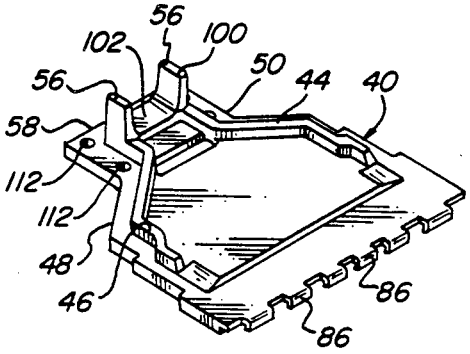
FIG. 3
FIG. 4
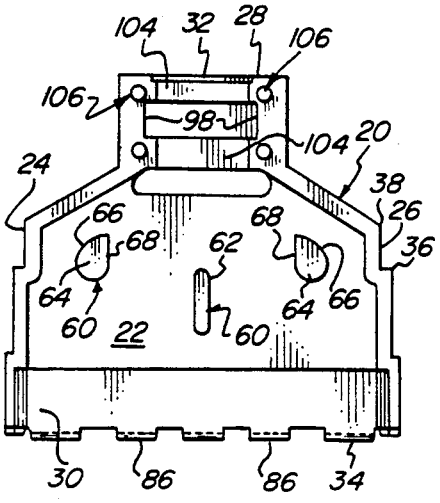

SHIELDED ELECTRICAL CONNECTOR AND CABLE

BACKGROUND OF THE INVENTION

1. Field of the Invention

The present invention relates to shielded electrical connectors of the type used to connect together with a mating electrical connector. Such connectors are typically with a multiple wire computer cable to connect circuit boards and other computer and computer peripheral components.

2. Background of the Prior Art

Regulations of the FCC relating to electromagnetic fields, particularly RF fields generated by computer equipment, have prompted the increased use of shielding in cables and electrical connectors. One shielding system is discussed in two prior patents to Frantz et al, namely U.S. Pat. Nos. 4,582,384 and 4,585,292, which disclose mating "clamshell" shields that mate together with the metal outer shell of an insulating connector housing which has a plurality of terminals therein. The shields are stamped from a sheet metal and are provided with pressure relief vents so that when an overmolded insulating jacket is applied to the shielded connector, the vents can pop open to relieve excess pressure However, in practice, the connectors disclosed in these patents have suffered from problems during overmolding with an outer plastic shell. Indeed, the problems of these connectors are similar to problems which had been noted with prior art unvented shields. In particular, the high pressures generated during the overmolding operation may crush the shields and/or cause components of a connector to become dislocated. Consequently, the terminals in the connector are splayed and misaligned so that the connector is either useless or requires substantial rework to correct the alignment before use. The prior art connector 510 in FIG. 8 illustrates the problem. As can be seen, there are two rows of pin terminals 512 in the connector and end pin receiving connectors 514. However, various of the pin terminals and pin receiving terminals, and particularly the end terminals 512 and 514, are misaligned. These terminals 512 and 514 are neither perpendicular to the vertical plane of the connector face nor parallel to the correctly aligned pins. Consequently, they will be difficult to mate with corresponding terminals in a mating connector. This problem is compounded when the overmolding material has flowed into the shielded area and then polymerized into a solid, encasing the wires and connectors and freezing them in their misaligned positions. Crushing of the shields during overmolding also poses the potential risk of creating improper and undesirable electrical connections among the various connectors contained therein.

It would be desirable if the problem of misaligned connectors inherent in the prior art could be resolved. This problem is addressed and resolved by the present invention as set forth hereafter.

SUMMARY OF THE INVENTION

It is an object of the invention to provide an electrical connector in which the terminals are properly aligned so that the connector can be easily mated with a mating connector. It is an object of the invention to provide an electrical connector which provides for and maintains alignment of cable wiring and the terminals attached thereto. It is an object of the invention to provide an electrical connector which is resistant to the forces created during overmolding processes.

These objects, and other objects which will become apparent from the description that follows, are achieved by a shielded electrical connector generally comprising a shield base and a shield cover, in which one or the other of the shield base or cover are provided with at least one conductor alignment column.

The shield base has a lower wall and two lateral side walls, and a cable receiving end and a connector receiving end. The shield cover mates with the shield base to form a shielded chamber. The shield cover has a substantially similar shape as the lower wall of the shield base. Both the shield base and the shield cover are preferably formed of an electrically conductive die cast composition of zinc. The conductor alignment column is located so that cable wiring within the shielded chamber formed by the base and cover is retained with the free end of the conductor aligned generally perpendicularly to the connector receiving end of the shield base.

Fasteners are provided to retain the cover and base together.

A connector module is located in the connector receiving end of the shield base and includes a plurality of electrical terminals, an electrically insulating housing containing the terminals, a conductive shell surrounding the insulating housing, and means for electrically conductive mating engagement of the conductive shell with the shield base and the shield cover to maintain a continuous RF shield.

Preferably there are at least two of the conductor alignment columns. Most preferably, there are a central alignment column, and two lateral alignment columns located on lateral sides of the central alignment column. Preferably, the alignment columns are provided with substantially rounded surfaces to avoid damage to the wiring. Most preferably, where there are three columns as mentioned above, the lateral alignment columns are generally semi-cardioid in cross-sectional shape and are provided with curved outer faces and with inwardly facing flat faces.

To provide maximum support for the shield cover, preferably the alignment columns extend from the lower wall of the shield base to the shield cover.

The conductors provided are part of a shielded computer cable having an outer shielding sleeve and a plurality of wires located in the sleeve. The wires extend beyond an end of the sleeve into the shielded chamber and are held in alignment with the terminals provided in the electrical connector by the wire alignment columns. The wires electrically connect with the terminals. The sleeve is in electrical contact with the shield base and the shield cover to maintain a continuous RF shield.

Other objects, aspects and features of the present invention in addition to those mentioned above will be pointed out in detail or will be understood from the following detailed description provided in conjunction with the accompanying drawings.

BRIEF DESCRIPTION OF THE DRAWINGS

FIG. 1 is a rear and bottom perspective view of a shielded electrical connector and cable in accordance with an embodiment of the invention.

FIG. 2 is an exploded front and top perspective view of the electrical connector of FIG. 1.

FIG. 3 is a perspective view of an embodiment of the underside of a shield cover of an electrical connector in accordance with an embodiment of the invention.

FIG. 4 is a top plan view of an embodiment of a shield base of an electrical connector in accordance with an embodiment of the invention.

DESCRIPTION OF THE PREFERRED EMBODIMENT

Figure 5:
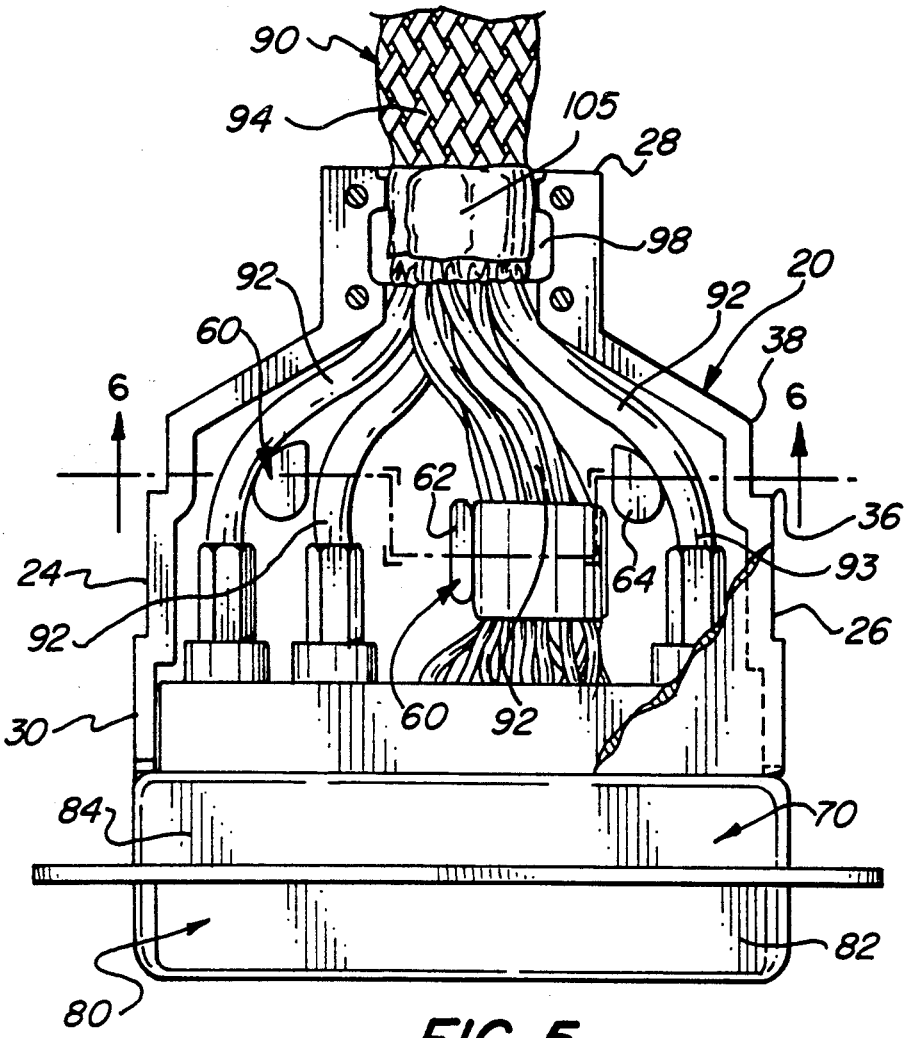
FIG. 5 is a top plan cutaway view of an embodiment of a cable and electrical connector in accordance with an embodiment of the invention.

With reference to FIGS. 1-7, where like numbers indicate like elements in the Figures, an electrical connector 10 is shown. Connector 10 comprises a shield 12 having a shield base 20 and a shield cover 40, both of which are die cast from an electrically conductive composition. In at least one or the other of the shield base 20 and a shield cover 40 is at least one conductor alignment column 60 as described in more detail hereafter.

The shield base 20 has a lower wall 22 and two lateral side walls 24 and 26. The base 20 has a cable receiving end 28 and a connector receiving end 30. Preferably, the connector receiving end 30 has a greater width than the cable receiving end 28 such that the lower wall 22 has a changing width from the connector receiving end 30 to the cable receiving end 28. The lateral side walls 24 and 26 conform with the changing width of the lower wall 22. Most preferably, the lower wall 22 is generally pentagonal in shape with the peak 32 of the pentagon corresponding to the cable receiving end 28 of the base 20 and with one side or a base 34 of the pentagon corresponding to the connector receiving end 30 of base 20. Preferably, the pentagon shaped base 20 has a width that increases by steps 36 from shoulders 38 of said pentagon shape to the base of the pentagon shape.

The shield cover 40 mates with the shield base 20 to form a shielded chamber 42. Shield cover 40 has a substantially similar shape as the lower wall 22 of the shield base 20. The shield cover 40 preferably has two ribs 44 and 46 located inwardly of lateral edges 48 and 50 of the shield cover 40. Ribs 44 and 46 are located to be fittable adjacently and inwardly of the lateral side walls 24 and 26 of the shield base 20 to provide additional shielding at this junction of the shield parts 20 and 40.

The at least one conductor alignment column 60 is located so that cable conductors 92 within the shielded chamber 42 are retained with the free ends 93 of the conductors 92 aligned generally perpendicularly to the connector receiving end 30 of the shield base 20. The alignment column 60 extends generally perpendicularly to both the lower wall 22 of the base 20 and to the cover 40. The alignment column 60 may be integrally formed with either the base 20 or the cover 40, however, in the preferred embodiment the alignment column 60 is formed integrally with the base 20.

Preferably there are at least two of the conductor alignment columns 60. Most preferably, there are a central alignment column 62, and two lateral alignment columns 64 located on lateral sides of the central alignment column 62. Preferably, the alignment columns 60 are provided with substantially rounded surfaces to avoid damage to the wiring. Most preferably, where there are three columns 62 and 64 as mentioned above, the lateral alignment columns 64 are generally semi-cardioid in cross-sectional shape and are provided with curved outer faces 66 and with inwardly facing flat faces 68.

To provide maximum support for the shield cover 40, in the preferred embodiment the alignment columns 60 extend from the lower wall 22 of the shield base 20 to the shield cover 40.

A connector module 70 is located in the connector receiving end 30 of the shield base 20. Connector module 70 includes a plurality of electrical terminals 72 such as terminal pins 74 and terminal pin receiving sockets 76. The terminals 72 are contained in an electrically insulating housing 78. Housing 78 may for example comprise an insulating plastic material. A conductive shell 80 surrounds the insulating housing 78. Shell 80 will typically comprise two mating pieces 82 and 84 which may be crimped together by foldover tabs. Means for electrically conductive mating engagement of the conductive shell 80 with the shield base 20 and the shield cover 40 are provided to maintain a continuous RF shield. In one embodiment, these may comprise hooks 86 provided on the connector receiving ends of the base 20 and cover 40, which hooks 86 fit into and engage slots 88 in the shell 80.

A computer cable 90 comprises a plurality of conductors or wires 92 which are contained within an outer shielding sleeve 94. The conductors 92 extend beyond an end 96 of the sleeve 94 into the shielded chamber 42 and are held in alignment with the terminals 72 in the electrical connector 70 by the alignment columns 60. The conductors 92 are electrically connected to the terminals 72. The sleeve 94 is in electrical contact with the shield base 20 and the shield cover 40 to maintain a continuous RF shield from the cable 90 through the connector 10.

The electrical contact between the cable shield or sleeve 94 and the shield base 20 and cover 40 is provided by a pair of tabs 56 on the cover 40 which clamp the sleeve 94 of cable 90 when the cover 40 is secured to the base 20. The two tabs 56 extend downwardly from the rear cable receiving end 58 of the cover 40 and fit snugly into slots 98 in the lateral sidewalls of base 20 along the cable receiving end 28 of the base 20. The tabs 56 have a tapering cross-section which is thickest adjacent the shield cover 40 and narrowest at their free ends 100. A rib 102 is formed between the tabs 56 and is curved to snugly clamp the sleeve 94 of cable 90. A similar rib 104 extends between the slots 98 on the base 20 to also clamp the sleeve 94. It is conventional to also wrap a thin strip of copper foil 105 around the cable 90 at the junction with the shield 12, although the shielding qualities of the present invention are such that the copper foil may be omitted. In addition, a ferrite annulus is often fitted over the cable at the cable receiving end of a connector shield to enhance shielding at this point. However, since the shielded connector of the invention provides excellent shielding without such an annulus, it may be omitted in some cases, depending on the system.

Fasteners 106 are provided to retain the cover 40 and base 20 together. In one embodiment, the fasteners each have a shank 108 and a head 110, and the shield cover 40 is provided with apertures 112 for receiving the shanks 108. The fasteners 106 secure the shield cover 40 to the shield base 20 with the fastener heads 110 located outwardly of the shield cover 40 with the shanks 108 extending through the apertures 112 and being secured to the lateral side walls 24 and 26. In one embodiment, the fasteners 106 may comprise threaded machine screws threaded into threaded holes in the lateral side walls 24 and 26. However, in a preferred embodiment, the fasteners comprise pins 114 integrally formed with the base 20. These pins extend through the apertures 112 and their heads 116 are peened to deform the pins to retain the cover 40 to the base 20.

In the preferred embodiment, the shield base 20 and shield cover 40 are formed by die casting from an electrically conductive composition of zinc.

Figure 7:
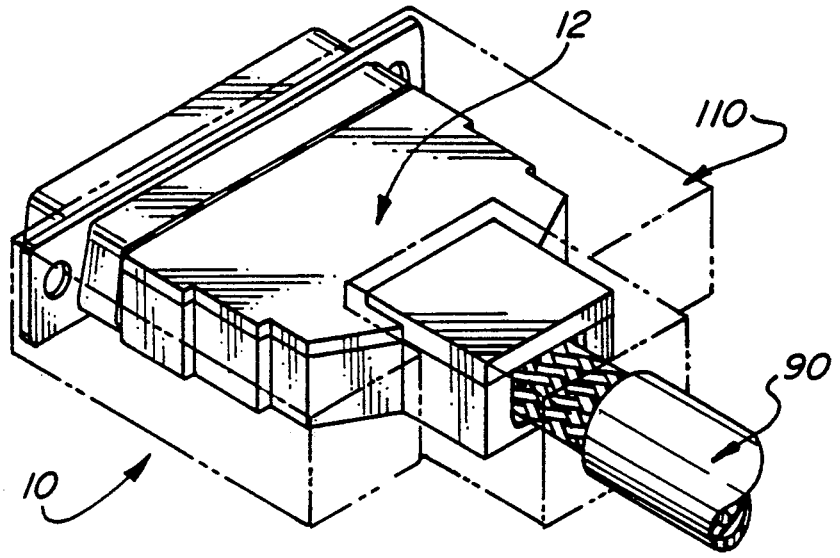
FIG. 7 is the perspective view of the electrical connector of FIG. 1 with an overmolded outer housing shown in phantom outline.
Figure 8:
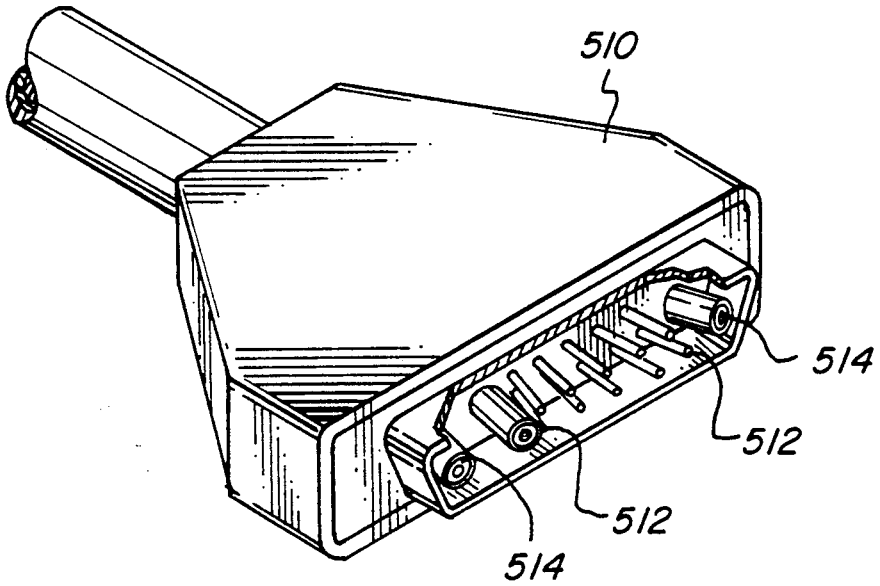
FIG. 8 (PRIOR ART)
FIG. 8 is the perspective view of a prior art overmolded connector illustrating the problems of terminal misalignment.

Referring now to FIG. 7, an outer plastic housing 110 may be applied to the assembled shield cover 40 and base 20 either by overmolding the plastic housing 110 over the shield 12 in an appropriate die, or by assembling a separately manufactured housing 110 onto the cable 90 until it fits snugly over the shield 12.

Figure 6:
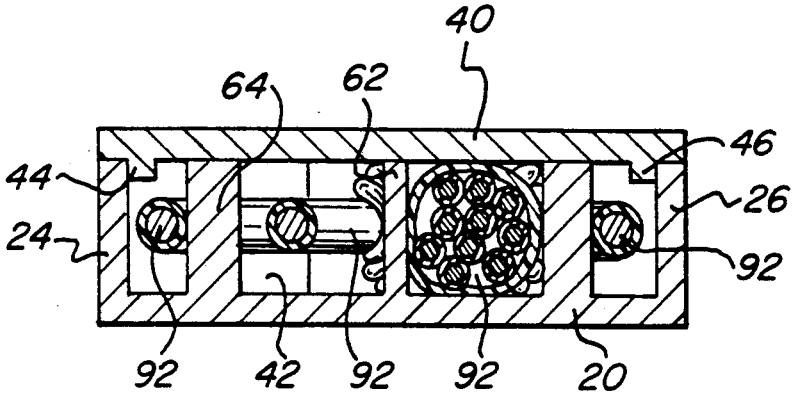
FIG. 6 is a cross-sectional view along the line 6—6 of FIG. 5.

As can be seen in FIGS. 2, 5 and 6, the alignment columns 60 guide the wires from the cable receiving end 28 to the connector receiving end 30. The columns 60 provide an alignment and stress relief function to prevent the conductors 92 from creating lateral forces on the terminals 74 and 76 that cause the terminals 74 and 76 to splay outwardly such that they are misaligned with terminals in a mating connector. This desirable result is obtained both where a housing is to be manufactured by overmolding or by separate manufacture and assembly.

The shielded connector 10 of the present invention has a substantial structural integrity, and this together with the alignment columns 60 prevent the misalignment of the terminal elements 72 during the overmolding operation. As a consequence, there are improved quality control and manufacturing efficiencies provided by the invention as well as more satisfied customers. The invention solves a problem long known in the art but never satisfactorily addressed.

The present invention therefore provides a novel and useful connector apparatus that has an effective shield and in which wiring is retained in its ultimate alignment with terminals in the connector. It is to be appreciated that the foregoing is illustrative and not limiting of the invention, and that the practitioner may also develop other embodiments all within the scope of the invention.

We claim:

1. An electrical connector shield assembly, comprising:

a shield base having a lower wall extending from a conductor receiving end to a connector receiving end, and lateral side walls extending upwardly from the lower wall, said shield base being formed of an electrically conductive die cast composition;

a shield cover shaped to matingly fit over said side walls of the shield base to form a shielded chamber, said shield cover being formed of an electrically conductive die cast composition;

said shield base having, as an integral part thereof, a die cast central conductor alignment columns, said lateral alignment columns being located on opposite lateral sides of said central alignment column, said central and lateral alignment columns extending upwardly from the lower wall in spaced relationship from the lateral side walls and extending sufficiently above the lower wall to support the shield cover against collapse and further being located to guide at least one conductor extending from the conductor receiving end to the connector receiving end into a desired alignment with a terminal of a connector module at the connector receiving end to reduce misalignment of the terminal; and means for securing said shield cover to said shield base;

the connector module being located in said connector receiving end of said shield base, said module having a plurality of electrical contact elements connected to respective conductors in a cable, an electrically insulating housing containing said electrical contact elements in predetermined terminal positions, a conductive shell surrounding said insulating housing, and means for establishing electrically conductive and mating engagement of said conductive shell with said shield base and said shield cover; and said lateral walls at the cable receiving end of said shield base being provided with slots and said shield cover being provided with cable clamping tab elements extending therefrom and sized to respectively fit into said slots, said cable clamping tab elements having a tapered cross-sectional shape with thicker portions being adjacent said shield cover and narrower portions being at ends of said tab elements.

2. An electrical connector shield assembly in accordance with claim 1, wherein said lateral conductor alignment columns are generally semi-cardioid in cross-sectional shape with curved faces which are opposite said lateral walls and with inwardly facing flat faces.

3. An electrical connector shield assembly in accordance with claim 1, further comprising:

a shielded cable having an outer shielding sleeve and a plurality of said conductors located in said sleeve, said conductors extending beyond an end of said sleeve into said shielded chamber and with selected ones of said conductors being guided by at least one of said lateral conductor alignment columns to be aligned with said electrical contact elements, said conductors being electrically connected with said electrical contact elements, and said sleeve being in electrical contact with said shield base and said shield cover.

4. An electrical connector shield assembly in accordance with claim 1, said shield cover having shielding ribs located along and inwardly of laterally opposed edges of said shield cover, said shielding ribs being so located as to fit adjacent to and inwardly of said lateral side walls of said shield base to provide enhanced electromagnetic shielding along a junction formed between said shield cover and said lateral side walls over the length of said shielding ribs.

5. A shielded electrical connector assembly for a plurality of conductors, comprising:

a shield base having a lower wall and lateral side walls extending upwardly from the lower wall, and a conductor receiving end and a connector receiving end; said connector receiving end having a greater width than said connector receiving end with said lower wall having an increasing width from said conductor receiving end to said connector receiving end, said lateral side walls conforming with said changing width of said lower wall, said shield base being formed of an electrically conductive die cast composition;

a shield cover shaped to matingly fit with upper ends of said lateral walls to form an electromagnetically shielded chamber, said shield cover having a substantially similar shape as said lower wall of said shield base, said shield cover having ribs respectively located inwardly of laterally opposed edges of said shield cover, said ribs being located to fit adjacently to and inwardly of said lateral side walls of said shield base to enhance electromagnetic shielding between the shield cover and said lateral side walls, said shield cover being formed of an electrically conductive die cast composition;

means for securing said shield cover to said shield base;

said conductor receiving end of said shield base being provided with slots in said lateral walls and said shield cover being provided with two tab elements extending therefrom and sized to fit into said slots, said tab elements having a tapered cross-section which is thickest adjacent said shield cover and narrowest at free ends of said tab elements to clamp against a cable at the conductor receiving end of said shield base;

a connector module located in said connector receiving end of said shield base, said module having a plurality of laterally spaced contact elements connected to said conductors, an electrically insulating housing containing said electrical contact elements, a conductive shell surrounding said insulating housing, means for establishing electrically conductive and mating engagement of said conductive shell with said shield base and said shield cover;

at least one die cast conductor alignment column being an integral part of the shield base and being spaced from one of said lateral side walls, and extending substantially perpendicularly from said lower wall of said shield base and substantially perpendicularly to said shield cover to impart structural support between said shield cover and said shield base to withstand collapsing forces caused by an overmolding operation; and the space between the column and said one lateral side wall being sufficient to permit a conductor to be located in said space with a desired alignment of said latter conductor with a contact element with reduced lateral forces that tend to misalign a contact element.

6. A shielded electrical connector assembly in accordance with claim 5, wherein said shield base a central support column, and at least first and second lateral conductor alignment columns respectively spaced on opposite lateral sides of said central support column.

7. A shielded electrical connector assembly in accordance with claim 6, wherein said conductor alignment columns are generally semi-cardioid in cross-sectional shape, and are provided with curved faces opposite said lateral side walls and with inwardly facing flat faces.

8. A shielded electrical connector assembly in accordance with claim 5, further comprising a shielded cable having an outer shield and a plurality of conductors located in said outer shield, said conductors being aligned with and electrically connected to said contact elements, said outer shield being in electrical contact with said shield base and said shield cover by the clamping section by said tapered tab elements.

9. A shielded electrical connector assembly in accordance with claim 5, wherein said shield cover and shield base are formed of an electrically conductive composition of zinc.

10. A shielded cable and connector assembly, comprising:

a cable formed of a plurality of individual conductors and an electromagnetic cable shield surrounding the conductors;

at least one connector housing having a conductor receiving end and a connector receiving end;

a connector mounted to the housing at the connector receiving end and having a plurality of contact element positions spread along the connector;

said cable conductors being assembled in a bunch within the electromagnetic cable shield and with the bunch captured within the conductor receiving end of the connector housing; selected ones of said conductors being spread out from the cable receiving end to terminate in contact elements located near lateral ends of the connector;

said connector housing being formed of a shield base and a separable shield cover; said shield base having a lower wall bounded by lateral side walls, with the shape of the shield base increasing in width from the conductor receiving end to the connector receiving end so that said conductors can be spread out inside the shield base to terminate in said contact elements at said connector positions;

said shield base lower wall having at least one alignment column being located in spaced relationship from the lateral side walls and from the connector receiving end of the shield base; and with the selected conductors being passed between the alignment column and the lateral side walls to establish a desired alignment of said conductors with the contact elements at said lateral ends of the connector;

said conductor receiving end of one of said shield base and shield cover being provided with slots in lateral walls thereof and the other of said shield base and shield cover being provided with two tab elements extending therefrom and sized to fit into said slots, said tab elements having a tapered cross-section which is narrowest at free ends of said tab elements, whereby said tab elements clamp against said cable shield to capture said conductors at the conductor receiving end of said connector assembly.

* * * * *